US007934325B2

(12) United States Patent
Sokolowski et al.

(10) Patent No.: US 7,934,325 B2
(45) Date of Patent: May 3, 2011

(54) GYMNASTICS FOOTWEAR

(75) Inventors: Susan L. Sokolowski, Portland, OR (US); Nuria Hansen, Portland, OR (US); Julia Roether, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 782 days.

(21) Appl. No.: 11/852,176

(22) Filed: Sep. 7, 2007

(65) Prior Publication Data

US 2009/0064540 A1 Mar. 12, 2009

(51) Int. Cl.
*A43B 5/12* (2006.01)

(52) U.S. Cl. ..... 36/8.3; 36/113; 36/59 R

(58) Field of Classification Search ..... 36/8.3, 36/113, 59 R, 59 C, 7.2, 7.4, 7.7, 11.5, 145
See application file for complete search history.

(56) References Cited

U.S. PATENT DOCUMENTS 1,396,313 A * 11/1921 Belknap ..... 36/59 C
1,638,842 A 8/1927 George
2,237,652 A 9/1938 Capezio
2,292,643 A 5/1940 Layana
2,486,886 A 3/1947 Saukkonen
2,954,617 A 5/1957 Yamaguchi
3,084,695 A * 4/1963 O'Donnell ..... 36/174
3,487,830 A 1/1970 Pruett
3,724,458 A 4/1973 Piper
4,277,897 A 7/1981 O'Connell
4,495,715 A 1/1985 Fredrickson et al.
5,205,071 A 4/1993 Hergenroeder
5,257,969 A 11/1993 Mance
5,282,782 A 2/1994 Kasahara
5,437,616 A 8/1995 Kasahara
5,554,107 A 9/1996 Shannahan
5,865,779 A 2/1999 Gleason
5,867,838 A 2/1999 Corry
6,018,888 A 2/2000 Wilkenfeld et al.
6,277,088 B1 * 8/2001 Novella ..... 36/145
6,694,647 B1 * 2/2004 Patterson et al. ..... 36/127
D499,807 S 12/2004 Stauffer
D520,217 S 5/2006 Kim
7,051,457 B1 5/2006 Huggins et al.
D535,461 S 1/2007 Wilkenfeld et al.
7,254,909 B2 8/2007 Ungari
7,673,396 B2 * 3/2010 Terlizzi et al. ..... 36/8.3
2006/0189460 A1 8/2006 Katterjohn
2006/0288609 A1 12/2006 Wilkenfeld et al.
2007/0006486 A1 1/2007 Wilkenfeld et al.

* cited by examiner

*Primary Examiner* — Ted Kavanaugh
(74) *Attorney, Agent, or Firm* — Banner & Witcoff, Ltd.

(57) ABSTRACT

An article of footwear for gymnasts includes an outsole, an insole, an upper, and a securing member. The outsole may extend beneath a forefoot region of the foot and may include one or more traction elements. The insole may be engaged with the outsole and may include one or more impact-attenuation zones. The insole may include a medial impact-attenuation zone and a lateral impact-attenuation zone. The upper may include one or more apertures through which a wearer's phalanges may be received and may extend over a top portion of the wearer's foot between the wearer's ankle and phalanges. The securing member may secure the article of footwear to the wearer's foot, and may extend from the lateral to the medial side of the upper. The securing member may extend around the heel or ankle area of the wearer's foot. The article of footwear may be a gymnastics shoe.

25 Claims, 7 Drawing Sheets

GYMNASTICS FOOTWEAR

FIELD OF THE INVENTION

Aspects of the invention relate generally to athletic footwear for gymnasts. More specifically, aspects of the invention relate to a gymnastics shoe that may provide a gymnast with increased traction for running and mounting gymnastics apparatuses and may reduce the effects of an impact on a gymnast's foot during execution of gymnastics moves.

BACKGROUND

A gymnast must combine strength, endurance, grace, and skill for the successful execution of gymnastics moves. Oftentimes, a gymnast is required to run and mount gymnastics apparatuses from a variety of surfaces. Surfaces may vary between gymnastics facilities and may cause a gymnast to slip or fail to obtain sufficient traction on an unfamiliar surface. For example, the vault typically includes a vault runway and carpet-covered plywood based platforms with steel mounting brackets. The carpet may be plush and may be manufactured from a polyethylene sport foam.

During execution of a gymnastics move on the vault, a gymnast usually runs at full speed down a runway at the end of which is a spring board and the vault. The gymnast jumps onto the spring board that provides the gymnast momentum, height, and speed to execute a gymnastics move. Ideally the gymnasts capitalize on their momentum, height, and speed and cause their bodies to rotate and flip over the vault. The gymnasts place their hands on the vault, perform a rotation or flip over the vault, and then land on the opposite side of the vault from the spring board. Most of the gymnastics moves that are executed on the vault require the gymnast to rotate in the air and land on their feet.

A gymnast's approach to the vault includes running at full speed down the vault runway towards a spring board and vault. Gymnasts oftentimes find that the ground contact surface of their feet slip against the carpet of the vault runway. Slipping alter the gymnast's approach and may result in significant injuries including twisted or sprained ankles or knees, broken bones, bruises, ligament and/or tendon tearing, and the like. A gymnast's approach to the spring board and vault is crucial to safely execute a gymnastics move on the vault.

After running down the vault runway, a gymnast jumps onto a spring board and causes their body to soar through the air at heights of over ten feet. The gymnast's approach provides the gymnast with sufficient speed, strength, and momentum to successfully execute a gymnastics move. A successful approach is crucial to providing the gymnast with sufficient speed, strength, and momentum to properly execute the gymnastics move and to obtain a high score during competition. Oftentimes, gymnasts suffer injuries during a landing from failing to gain enough speed, strength, and momentum from their approach to properly jump onto the spring board and begin the gymnastics move as their body rotates over the vault. After an injury, the gymnast is prevented from training and competing, which may result in delayed advancement of skill, missed competition, and painful physical therapy during recovery. Some gymnastics injuries are so severe that a gymnast is forced to retire from the sport entirely.

During execution of a gymnastics move on the vault, many gymnasts wear gymnastics shoes to provide traction and increase support during their approach and for their landing. Most of these gymnastics shoes cover the entire foot of the gymnast and are bulky and uncomfortable. Gymnastics shoes often irritate the gymnast's foot during wear and/or prevent the gymnast's foot from properly flexing. Some gymnastics shoes include an upper with apertures through which the gymnast's toes extend during wear and a strap that attaches to the gymnast's foot either around the midfoot region or around the heel. The apertures extend between the gymnast's toes and provide a more barefoot feeling to the gymnast as compared to the bulky and heavy feeling caused by gymnastics shoes that cover the gymnast's entire foot. Oftentimes, gymnastic shoes that include apertures for the toes fail to provide adequate support and attachment to gymnastics shoes for the gymnast's foot.

Additionally, a significant portion of gymnastics shoes are made with a material that fails to provide adequate breathability or elasticity for the gymnast's foot. Most gymnasts do not wear socks or other protective material in conjunction with the gymnastics shoes and their feet will suffer skin irritation and discomfort during wear. Some gymnastics shoes have a traction material that is attached to the surface that contacts the ground and that is designed to provide additional friction for the gymnast's foot as it contacts the ground.

Therefore, while some gymnastics shoes are currently available, there is room for improvement in this art. For example, a gymnastic shoe that provides a gymnast with increased foot support and traction during execution of gymnastics moves while remaining comfortable and flexible for the gymnast's foot would be a desirable advancement in the art. Additionally, a gymnastics shoe made from a material that is adequately breathable and elastic would also be welcomed in the art.

SUMMARY

The following presents a general summary of aspects of the invention in order to provide a basic understanding of at least some of its aspects. This summary is not an extensive overview of the invention. It is not intended to identify key or critical elements of the invention and/or to delineate the scope of the invention. The following summary merely presents some concepts of the invention in a general form as a prelude to the more detailed description provided below.

Aspects of this invention relate to athletic footwear for gymnasts. In an aspect, a gymnastic shoe may have an outsole, an insole, an upper, and a securing member. The outsole may be sized to extend beneath a forefoot region of a wearer's foot and may terminate in the midfoot region of the wearer's foot. The outsole may also include an exposed surface that includes one or more traction elements. The insole may be engaged with the outsole and may provide a surface for engaging a wearer's foot. The insole may also include a medial forefoot impact-attenuation zone and a lateral foreforefoot impact-attenuation zone. The upper may include plural apertures for receiving phalanges of a wearer's foot and may extend over a top portion of the wearer's foot between the wearer's ankle and the phalanges. The securing member may extend from a lateral side of the upper to a medial side of the upper and may form a loop to extend around a rear heel or ankle area of the wearer's foot.

Additional aspects of this invention relate to articles of footwear that include an outsole, an insole, an upper, and a securing member for securing the shoe to the wearer's foot. The outsole may be sized to extend beneath a forefoot region of a wearer's foot and may terminate in the midfoot region of the wearer's foot. The outsole may also include one or more traction elements. The insole may be engaged with the outsole and may provide a surface for engaging a wearer's foot. The insole may also include plural discrete impact-attenuation zones. The upper of this footwear structure may include at least one aperture through which at least one phalange of a wearer's foot may extend. The upper may also extend over a top portion of the wearer's foot between the wearer's ankle and phalanges.

Still additional aspects of the invention relate to a gymnastics shoe that includes an outsole, an insole, an upper, and a securing member where the upper and the insole define a space for fittingly engaging with the wearer's foot. The outsole may be sized to extend beneath a wearer's foot and may include a ground contact surface having one or more traction elements. The insole may be engaged with the outsole and may include at least one impact-attenuation zone. The upper may include plural apertures for receiving phalanges of a wearer's foot. The securing member may secure the gymnastics shoe to the wearer's foot and may include a heel strap that extends from a lateral side of the upper to the medial side of the upper.

BRIEF DESCRIPTION OF THE DRAWINGS

A more complete understanding of the present invention and certain advantages thereof may be acquired by referring to the following description along with the accompanying drawings, in which like reference numbers indicate like features, and wherein.

Figure 1:
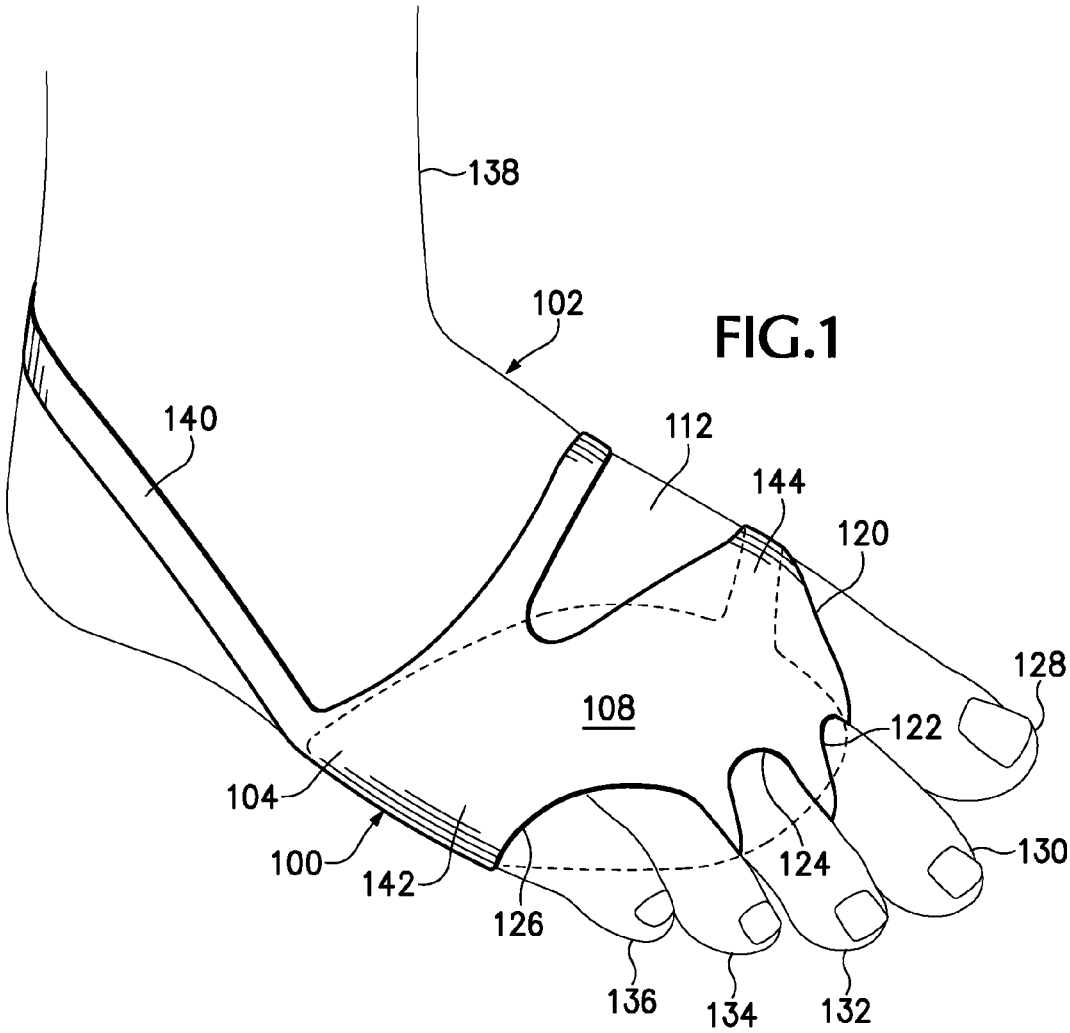
FIG. 1 illustrates an article of footwear attached to a wearer's foot, in accordance with an embodiment of the invention.

The reader is advised that the attached drawings are not necessarily drawn to scale.

DETAILED DESCRIPTION

In the following description of various example embodiments of the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

A. General Description of an Article of Footwear According to Examples of the Invention In general, as described above, aspects of the invention relate to articles of footwear for gymnasts. In accordance with at least some aspects of the invention, an article of footwear for a gymnast may include: (a) an outsole sized to extend beneath a forefoot region of the wearer's foot, wherein an exposed surface of the outsole includes one or more traction elements; (b) an insole engaged with the outsole and providing a surface for engaging a wearer's foot, wherein the insole includes a medial forefoot impact-attenuation zone and a lateral forefoot impact-attenuation zone; (c) an upper including plural apertures for receiving phalanges of a wearer's foot, the upper extending over a top portion of the wearer's foot between the wearer's ankle and phalanges; and (d) a securing member extending from a lateral side of the upper to a medial side of the upper, the securing member forming a loop to extend around a rear heel or ankle area of the wearer's foot.

The outsole may be the ground-contact surface of the article of footwear and may be included as an attached or detachable layer of the article of footwear. The ground-contact surface is the exterior surface of the outsole that engages the ground when a foot of a wearer contacts the ground. In at least some examples, the outsole may include one or more traction elements that may cause friction between the outsole and the ground. The friction may provide the wearer with "grip" or "stability" when the outsole contacts the ground and may help prevent the outsole and the ground from sliding against one another during contact (e.g. when the wearer runs, plants his or her foot, pushes off of an object, lands, etc.).

The outsole may be sized to meet the lengths and widths that are associated with the European and/or the United Kingdom and American standard units or may be customized to the dimensions of a wearer's foot. Articles of footwear for men may be sized differently than the articles of footwear for women. In at least some examples, the outsole may be sized to extend beneath a forefoot region of the wearer's foot. An outsole that extends beneath a forefoot region of the wearer's foot may terminate in a midfoot region of the wearer's foot and may be positioned only within the forefoot region of the wearer's foot. An outsole may extend throughout any desirable region of the wearer's foot, e.g., depending on the desired use, aesthetics, desired weight savings, etc.

Footwear structures in accordance with at least some examples of the invention may include an outsole engaged with an insole. The outsole may be engaged with the insole in any desired manner including, but not limited to in a layered fashion via sewing or stitching, via adhesives, via mechanical connectors, etc.

The outsole and/or insole may include comfort-enhancing features such as suitable polymer foam materials (such as ethylvinylacetate or polyurethane) that compress resiliently under an applied load to attenuate ground reaction forces. Conventional polymer foam materials are oftentimes resiliently compressible. The comfort-enhancing features may be included with the outsole and/or insole any desired manner, including by forming the insole and/or outsole from these materials, sandwiching the comfort-enhancing material between insole and outsole elements, etc. The comfort-enhancing materials may be included within the outsole or the insole and may be permanently or detachably attached to the outsole and/or insole.

In at least some examples, an article of footwear for a gymnast may contain an impact-attenuating zone that may be positioned to extend beneath the forefoot, midfoot, and/or heel region(s) of the wearer's foot. Impact-attenuation zones may be positioned in any desirable region or regions of the wearer's foot. In some more specific examples, an article of footwear may include one or more impact-attenuation zones in a forefoot region of a wearer's foot.

As another example, an article of footwear may include one or more impact-attenuation zones in a midfoot region of a wearer's foot. As yet another example, an impact-attenuation zone or zones may be positioned in the heel region of a wearer's foot. In some specific example structures in accordance with this invention, an article of footwear may have more than one impact-attenuation zone that is positioned in any region of the foot, e.g., a medial impact-attenuation zone and a separate lateral impact-attenuation zone positioned within the forefoot region of the wearer's foot.

Additionally, the impact-attenuating zones or materials may be flexible and may be detachable from the outsole and/or insole. A first impact-attenuation material having a first set of properties may be interchangeable with second impact-attenuation material having a second set of properties. For example, a first impact-attenuation material may be made of flexible material and may provide a moderate level of impact-attenuation and a second impact-attenuation material may be made of a material that is more rigid than the flexible material of the first-impact attenuation zone and may provide a high level of impact-attenuation. Any suitable material or plurality of materials may be used to create an impact-attenuation zone and/or material and the invention is not limited to the materials disclosed herein. The insole and/or outsole may include an opening to allow access to an interchange of the various impact-attenuation materials.

The upper may be attached to the outsole and/or the insole and may define a space for receiving a foot of a wearer. In many conventional articles of footwear, the upper may be fittingly engaged with the foot of a wearer. In some examples, the upper may include an aperture or plural apertures for receiving phalanges of a wearer's foot and through which phalanges of a wearer's foot may extend and fittingly engage with the upper. In at least some aspects, the upper may extend over at least a portion of the top of the wearer's foot between the wearer's ankle and phalanges.

A securing member may at least partially secure the article of footwear to the wearer's foot and/or hold the article of footwear in place with respect to the wearer's foot. In at least some aspects of the invention, the securing member may be attached to at least one of the outsole, insole, and/or upper. The securing member may at least partially cause the insole and the upper to be fittingly engaged with the wearer's foot, in at least some aspects. For example, the securing member may be a loop that extends from a lateral side of the upper to a medial side of the upper and around a rear heel or ankle area of the wearer's foot. Optionally, the securing member may contain an elastic material, a slider, and/or a hook and loop fastener. Any desirable securing member may be implemented, known and unknown.

In general, another aspect of the invention relates to an article of footwear that comprises: (a) an outsole sized to extend beneath a forefoot region of a wearer's foot, wherein the outsole terminates in a midfoot region of the wearer's foot, and wherein an exposed surface of the outsole includes one or more traction elements; (b) an insole engaged with the outsole and providing a surface for engaging a wearer's foot, wherein the insole includes plural discrete impact-attenuation zones; (c) an upper including at least one aperture through which at least one phalange of a wearer's foot extends, the upper extending over a top portion of the wearer's foot between the wearer's ankle and phalanges; and (d) a securing member for securing the article of footwear to the wearer's foot.

In general, another aspect of the invention relates to a gymnastics shoe and may comprise: (a) an outsole sized to extend beneath a wearer's foot, wherein the outsole includes a ground contact surface having one or more traction elements; (b) an insole engaged with the outsole including at least one impact-attenuation zone; (c) an upper including plural apertures for receiving phalanges of a wearer's foot; and (d) a securing member for securing the gymnastics shoe to the wearer's foot, the securing member including a heel strap that extends from a lateral side of the upper to the medial side of the upper; wherein the upper and the insole define a space for fittingly engaging with the wearer's foot.

Specific examples of the invention are described in more detail below. The reader should understand that these specific examples are set forth merely to illustrate examples of the invention, and they should not be construed as limiting the invention.

B. Specific Examples of the Invention

The various figures in this application illustrate examples of articles of footwear for gymnasts according to this invention. When the same reference number appears in more than one drawing, that reference number is used consistently in this specification and the drawings to refer to the same or similar parts throughout.

Figures 2, 3:
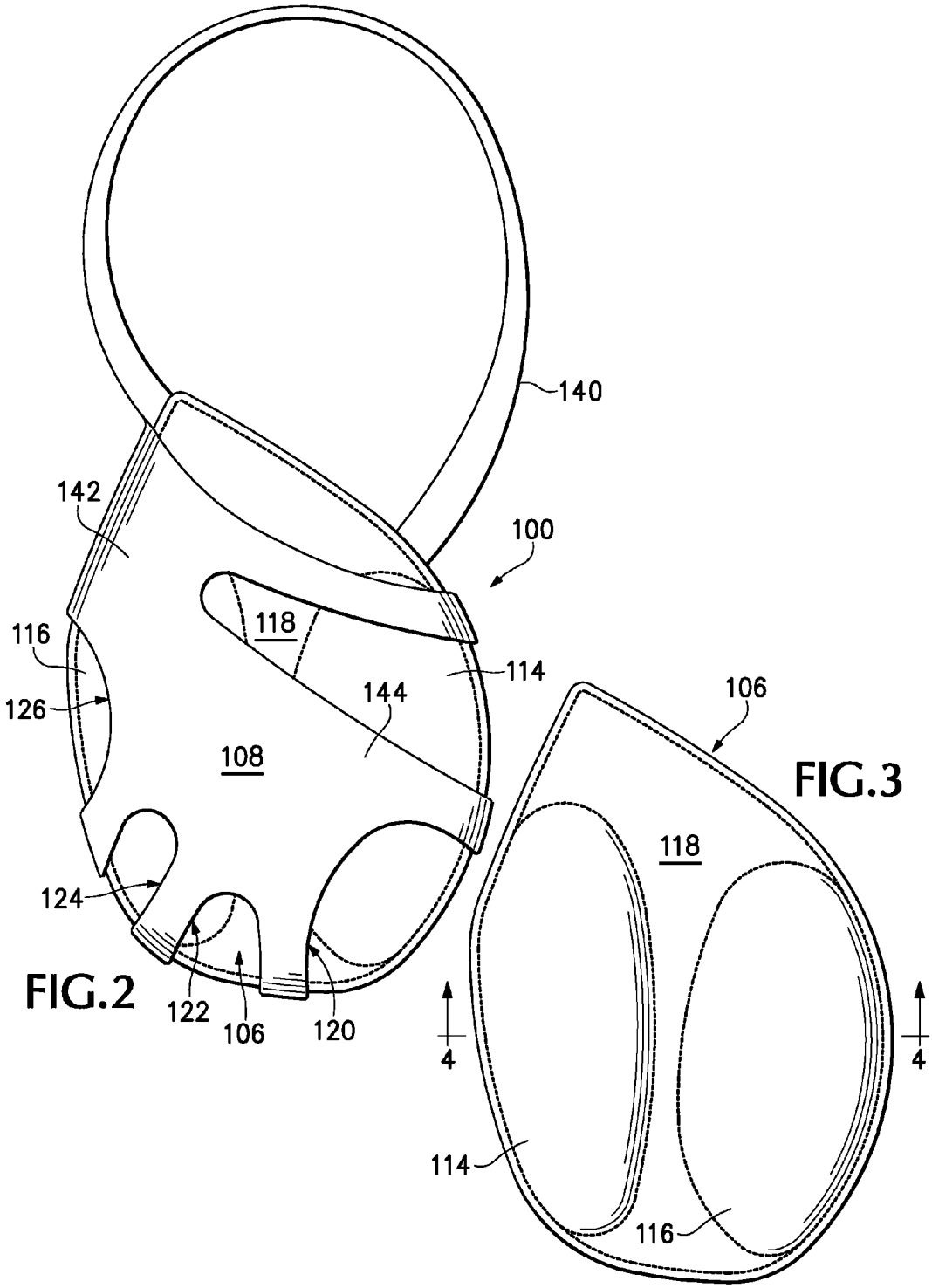
FIG. 2 illustrates an example of the article of footwear for a gymnast, according to aspects of the invention.
FIG. 3 illustrates an example of an insole for a gymnastics shoe that is engaged with an outsole of a gymnastics shoe, in accordance with an aspect of the invention.

FIG. 1 illustrates an example of the article of footwear 100 on the foot 102 of a wearer, in accordance with one aspect of the invention. As described in detail above, the article of footwear 100 may comprise an outsole 104, an insole 106, an upper 108, and a securing member 110, as shown in FIGS. 1 and 2. A gymnast may wear a gymnastics shoe, such as the article of footwear 100, while performing gymnastics moves and routines. The gymnast may utilize the gymnastics shoe 100 to aid in attenuation of impact forces and to increase friction during landing of the moves and routines.

Referring again to FIG. 1, the outsole 104 may extend beneath the forefoot region 112 of a wearer's foot, as illustrated by the dotted outline of an outsole 104. Oftentimes, a gymnast may perform a move or execute a landing and cause force to be applied to the forefoot region 112 of the foot, and the outsole 104 may attenuate at least a portion of this force. Further, the outsole 104 may have a ground-contact surface (not shown) that may be directly engaged with the ground during the performance of a move or the execution of a landing. The ground-contact surface may include one or more traction elements that increase the friction that is created by the contact of the outsole 104 and the ground, as described in detail below.

Referring now to FIG. 2, the insole 106 may be engaged with the outsole 104 and may provide a surface for engaging a wearer's foot (not shown). The insole 106 may be substantially similar to the shape of the perimeter of the outsole 102. The insole 106 may have a first portion and a second portion, wherein the first portion has a first set of properties and the second portion has a second set of properties. The insole 106 may include any desired number of discrete portions and correspondingly set of properties.

A gymnastics shoe may include a suede insole 106 that may help to prevent a gymnast's foot from slipping within the shoe. The insole 106 may be manufactured from any desired material that provides adequate friction qualities between the gymnast's foot and the insole 106.

For example, FIG. 2 illustrates a medial forefoot impact-attenuation zone 114 and a lateral forefoot impact-attenuation zone 116. The medial forefoot impact-attenuation zone 114 may extend beneath the medial forefoot region 112 of a wearer and may have a first set of properties. The first set of properties may include at least one of flexion, elasticity, stretch, absorption, and the like. The medial forefoot impact-attenuation zone 114 may be positioned to extend beneath the forefoot region 112 of a wearer on the medial side (e.g., beneath the big toe or hallux and/or the region extending rearward from it).

The lateral forefoot impact-attenuation zone 116 may extend beneath the lateral forefoot region 112 of a wearer and may have a second set of properties. The second set of properties may include at least one of flexion, elasticity, stretch, absorption, and the like. The second set of properties may be substantially similar to the first set of properties that is associated with the medial forefoot impact-attenuation zone 114. The second set of properties may also include at least one property that is not included in and/or that is substantially different from the first set of properties. The lateral forefoot impact-attenuation zone 116 may be positioned to extend beneath the forefoot region 112 of a wearer on the lateral side (e.g., beneath one or more of the laterally located toes or phalanges and/or the region extending rearward from them).

As illustrated in FIGS. 2 and 3, a central zone 118 may be positioned adjacent to the medial forefoot impact-attenuation zone 114 and/or the lateral forefoot impact-attenuation zone 116. For example, the medial forefoot impact-attenuation zone 114 and the lateral forefoot impact-attenuation zone 116 may be positioned on either side of the central zone 118. The central zone 118 may extend along the central portion of the forefoot region 112 of the wearer's foot and may be substantially aligned with the second and third phalanges of the wearer's foot 102.

The central zone 118 may or may not have impact-attenuation properties (or its impact-attenuation properties may be somewhat less than those zones 114 and/or 116). Conventionally, the central zone 118 may attenuate less impact than the medial forefoot impact-attenuation zone 114 and/or the lateral forefoot impact-attenuation zone 116. As is apparent from FIG. 3, the medial forefoot impact-attenuation zone 114 and the lateral forefoot impact-attenuation zone 116 may be shaped differently from one another, but if desired, they may be of the same shape. Likewise, the central zone 118 may be of the same or a different shape than either or both of the medial forefoot impact-attenuation zone 114 and the lateral forefoot impact-attenuation zone 116.

Referring again to FIGS. 1 and 2, the upper may include plural apertures for receiving phalanges of a wearer's foot 102. For example, a gymnastics shoe may contain four apertures 120, 122, 124, and 126 that receive the hallux 128, the second phalange 130, the third phalange 132, and the fourth and fifth phalanges 134, 136, respectively. In at least some examples of the invention, at least two phalanges may be received by one of the plural apertures. In FIGS. 1 and 2, the fourth and fifth phalanges 134, 136, respectively may extend through the aperture 126. Each of the plural apertures may be shaped to receive the phalanges and cause the upper to fittingly engage with the space between each of the phalanges (not shown).

In at least some examples of the invention, the upper 108 extends over a top portion of the wearer's foot 102, as illustrated in FIG. 1. The upper 108 may extend over the top portion of the wearer's foot 102 in a position between the wearer's ankle 138 and the wearer's phalanges 128, 130, 132, 134, and 136, respectively. In at least some examples, the upper 108 may define an space that causes the upper to comfortably engage with the top of the wearer's foot during flexion and extension, as shown in FIGS. 1 and 2.

The article of footwear 100 for gymnasts, according to this example of the invention, also includes a securing member 140. In this illustrated example, the securing member 140 may extend from a lateral side of the upper 142 to a medial side of the upper 144 and may form a loop to extend around a rear heel or ankle area 138 of the wearer's foot, as described in detail above. The securing member 140 may be any desirable securing member known in the art and may include those securing members that are known and not yet known in the art.

The securing member 140 may be attached to at least one of the outsole 104, the insole 106, and/or the upper 108. For example, the securing member 140 that is illustrated in FIG. 1 may be attached to the upper 108. In another example, the securing member 140 may be attached to the insole 106 and the outsole 108, as illustrated in FIG. 2. Further, the securing member may be attached between the insole 106 and the outsole 104 in a forefoot or midfoot region of the wearer's foot.

The securing member 140 may contain at least one of an elastic member, a slider, and a hook and loop fastener. The elastic member, slider, and/or hook and loop fastener may be positioned in any desirable location around the loop of the securing member 140. For example, the securing member 140 may contain elastic that causes the loop to fittingly engage with the rear heel and/or ankle area 138 of the wearer's foot. The securing member 140 may also be made of leather and/or suede and may include a slider (not shown) that is positioned near the lateral side of the ankle of the wearer's foot 138. In yet another example, the securing member may include elastic and a hook and loop fastener, wherein the hook and look fastener is positioned near the lateral side of the ankle of a wearer's foot 138.

Figure 4:
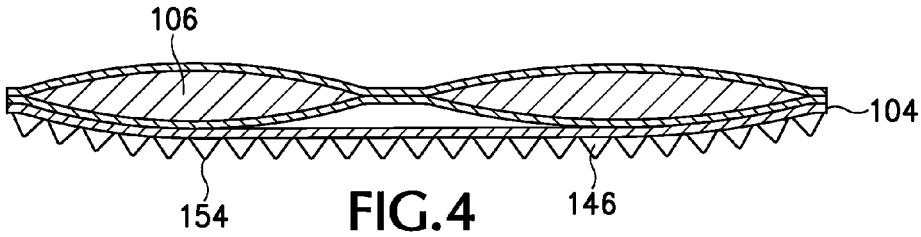
FIG. 4 illustrates a cross sectional view of an insole of a gymnastics shoe that is engaged with an outsole of a gymnastics shoe taken along line 4-4 of FIG. 3, according to an aspect of the invention.

FIG. 4 is a cross-sectional view of the outsole 104 and insole 106, taken along line 4-4 of FIG. 3. As described above, the insole 106 may be engaged with the outsole 104, e.g., by at least one of an adhesive, hook and loop fastener, stitching, mechanical fasteners, or the like. Further, the outsole 104 may be detachable from the insole 106 and/or interchangeable with respect to the insole 106.

For example, FIGS. 2-4 illustrate an insole 106 that is engaged with an outsole 104 by adhesive and stitching. A worn outsole may be detached from the insole and replaced with a new outsole. Further, a first outsole having a first set of properties may be detached from the insole 106 and replaced with a second outsole having a second set of properties. The first set of traction properties may provide the gymnast with traction characteristics that are different from the second set of traction properties. The insole 160 may be engaged with the outsole 104 in any desirable manner without departing from the invention.

As shown in FIG. 4, the medial forefoot impact-attenuation zone 114 and the lateral forefoot impact-attenuation zone 116 may have a thickness that is greater than the central zone 118. The central zone 118 may be positioned between the medial forefoot impact-attenuation zone 114 and the lateral forefoot impact-attenuation zone 116, as illustrated in FIGS. 2-4.

Figure 5:
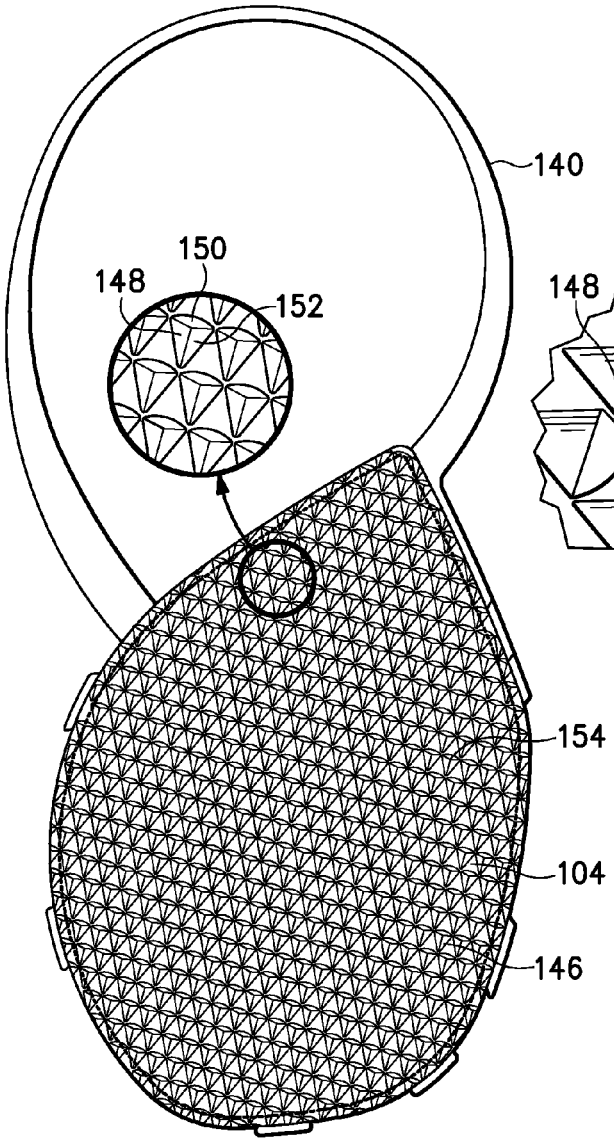
FIG. 5 illustrates a gymnastics shoe including features according to at least some aspects of the invention.
Figure 6:
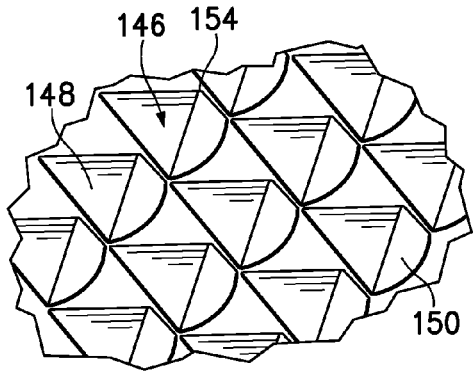
FIG. 6 illustrates an example of a traction element, according to at least some example aspects of the invention.

The outsole 104 may include one or more traction elements 146 of any desired shape and size. Each of the traction elements 146 may be the same or a different shape and size. For example, each of the traction elements 146 may be substantially similar in shape and size and may be shaped to be a polygon. As shown in FIGS. 4-6, the polygon may be a three-sided polygon having a first side 148 that has a first dimension, a second side 150 that has a second dimension, and a third side 152 that has a third dimension, wherein the first side 148, second side 150, and third side 152 may each be shaped in a substantially triangular shape (optionally with one or more sides somewhat curved). Each of the first side 148, the second side 150, and the third side 152 may be positioned adjacent to one another in a pyramid shape that defines a point 154. The point 154 of each polygon may define the ground-contact surface of the outsole 104.

Each polygon may contain a resilient material that may flex and compress to attenuate impact as a gymnast performs gymnastics moves and routines. Further, the resilient material may compress and return to its original shape or a substantially similar shape. Conventionally, the polygon may contain a rubber or other material that may cause friction between the traction element or elements 146 and the ground or landing surface.

Figure 7:
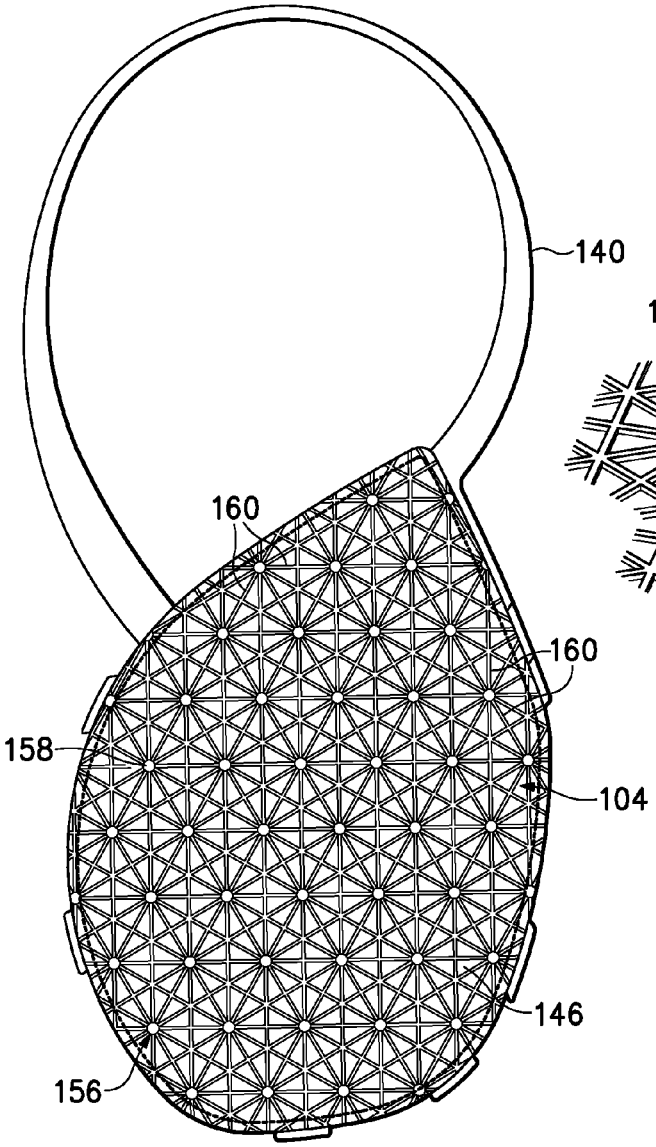
FIG. 7 illustrates another example of a gymnastics shoe including features according to at least some aspects of the invention.
Figure 8:
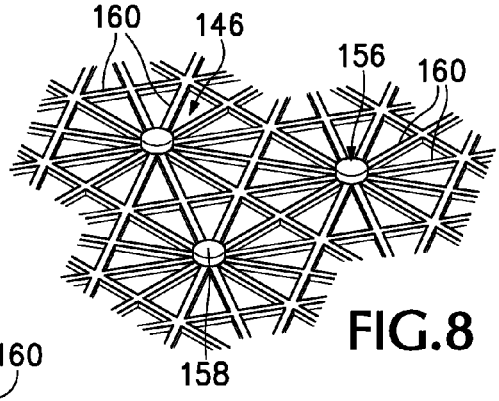
FIG. 8 illustrates an example of a traction element, in accordance with at least some aspects of the invention.

FIGS. 7 and 8 illustrate another embodiment of the plural traction elements 146. Each of the traction elements 146 may be shaped to be a web 156 and may be of a substantially similar dimension. For example, the web may be defined by a raised central point 158 and a plurality of raised straight lines 160 that extend away from the central point to form a six-sided polygon, as shown in FIGS. 7 and 8. The web 156 may be defined by any desired shapes, e.g., interlinked shapes, and it may have any desired number of sides without departing from the invention.

Figure 9:
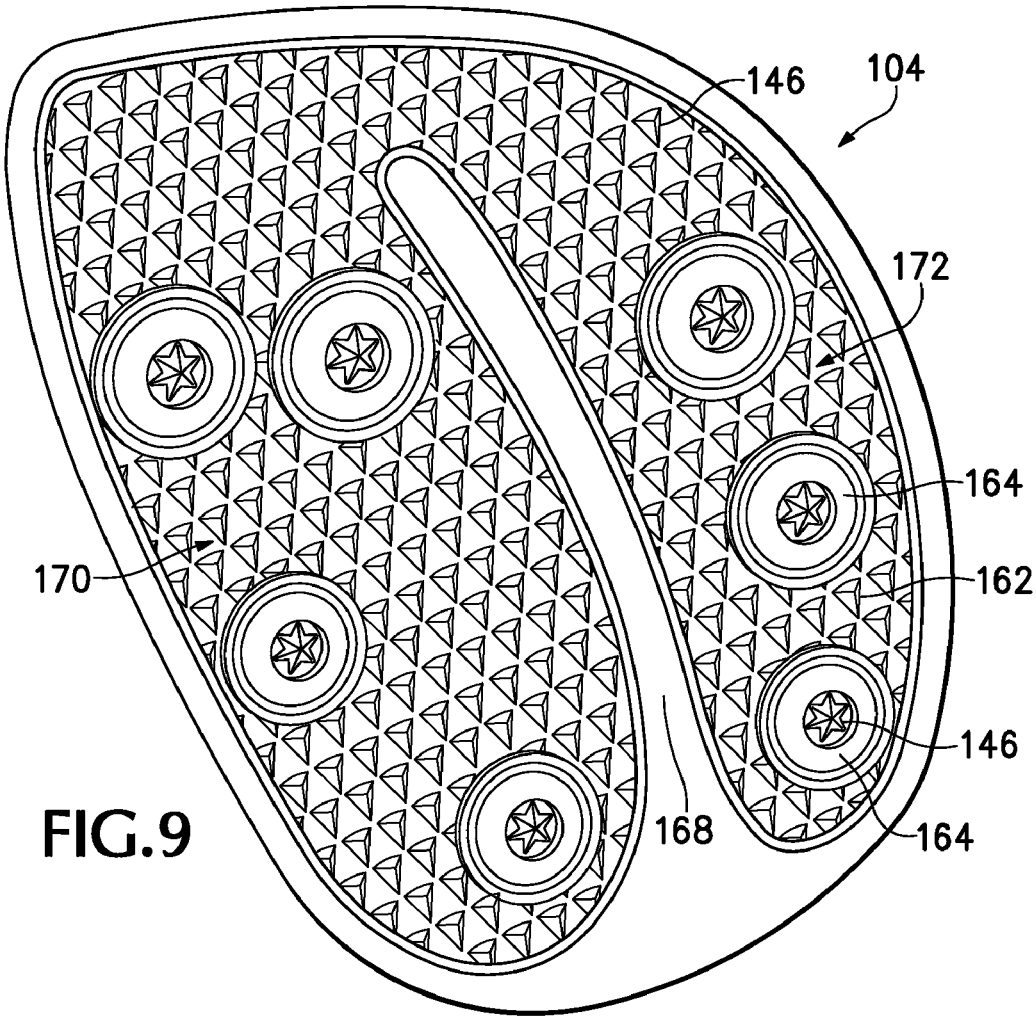
FIG. 9 illustrates an example of an outsole including features according to at least some aspects of the invention.

In yet another embodiment, the plural traction elements 146 may be shaped to be a first shape 162 and a second shape 164 that is different from the first shape, as illustrated in FIG. 9. For example, the first shape 162 may be a polygon and the second shape 164 may be a circle. As shown in FIG. 9, the polygon may be a three-sided polygon of a substantially pyramid-shape, as described in detail above. The circle may include a raised rim and a raised center point, e.g., shaped to be a six-point star 166 or other structure that extends away from the traction element 146 and contacts the ground or landing surface.

A divider 168 may define a medial region 170 of the outsole and a lateral region 172 of the outsole, as illustrated in FIG. 9. The divider 168 may extend from a distal surface of the outsole 104 into the forefoot region 112 of the outsole. The medial region 170 of the outsole may have a plurality of traction elements 146 including plural polygon-shaped traction elements and plural circle-shaped traction elements. The lateral region 172 of the outsole may also contain a plurality of traction elements 146 including plural polygon-shaped traction elements and plural circle-shaped traction elements. The medial region 170 of the outsole and the lateral region 172 of the outsole may include any desired combination of traction elements 146. The illustrated arrangement of traction elements 146 shown in FIG. 9 provides good traction at various locations where the foot typically contacts and exerts force against the ground or landing surface during a wearer's use.

According to at least some aspects of the invention, the first dimension of the pyramid-shaped polygon structure of the traction elements 146 may be different from at least one of the second and the third dimension. FIG. 6 illustrates several traction elements 146 shaped in a three-sided polygon having a first side 148 that defines a first area that is different from a second area defined by a second side 150 of the polygon. The edges of the polygon may be substantially straight or may be rounded or beveled. Additionally, the polygon-shaped traction elements may extend away from the surface of the outsole 104 toward the ground or landing surface.

Figure 11:
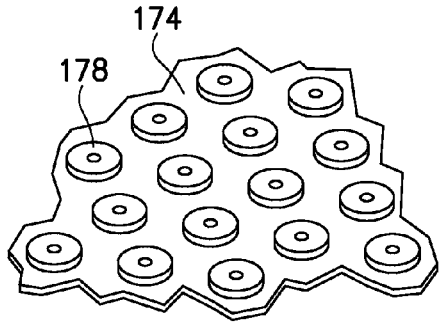
FIG. 11 illustrates an example of an interior surface of an insole, in accordance with at least some example aspects of the invention.
Figure 10:
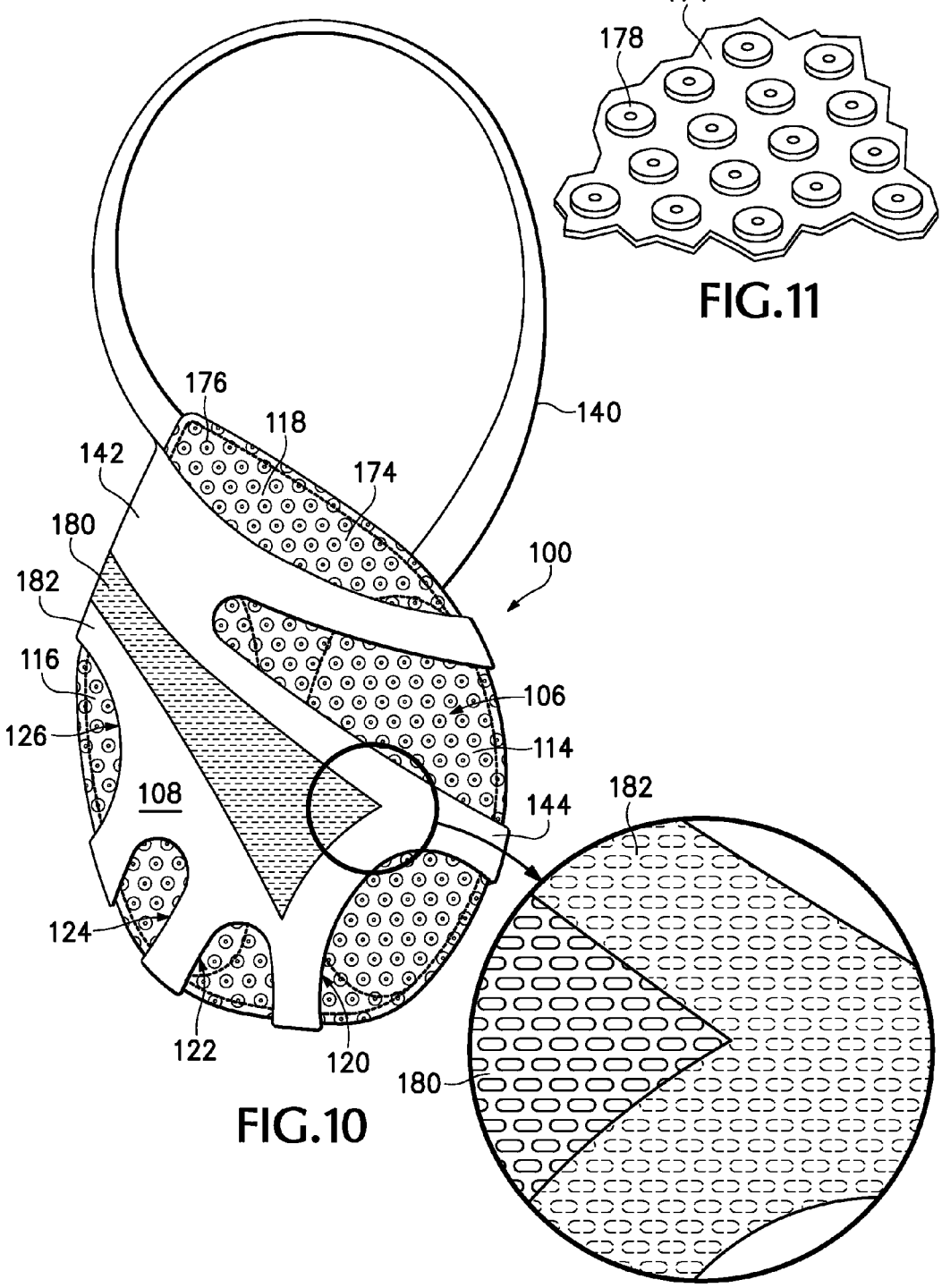
FIG. 10 illustrates another example of a gymnastics shoe including features according to at least some aspects of the invention.

FIGS. 10 and 11 illustrate a gymnastics shoe 100 having an insole 106 with an interior surface 174 that is configured to create friction between the interior surface 174 during use by the wearer. The insole 106 may include a friction surface 176 that engages with the wearer's foot and causes friction between the friction surface 176 and the wearer's foot 102. The friction surface 176 may include a plurality of friction elements 178, as illustrated in FIGS. 10 and 11. The friction elements 178 may be circular in shape or may be any other desired shape. Additionally, each of the friction elements 178 may be the substantially the same shape and size.

FIG. 10 illustrates an upper 104 having a first region 180 with a first set of properties and a second region 182 having a second set of properties that is different from the first set of properties. The first set of properties may include at least one of an elasticity and breathability. The elasticity is associated with the ability of the material comprising the first region 180 and/or second region 182 to expand from a first shape to a second shape and contract to a shape that is substantially similar to the first shape. The breathability is associated with the ability of the material comprising the first region 180 and/or second region 182 to permit air to transcend through the material. Additionally, the breathability may also be associated with the ability of the material comprising the first region 180 and/or second region 182 to absorb and/or shed liquid.

For example, the first region 180 of the upper 104 has a first set of properties may include a first elasticity and the second set of properties may include a second elasticity that is different from the first elasticity. Additionally, the first set of properties may include a first breathability and the second set of properties may include a second breathability that is different from the first breathability.

Referring again to FIG. 10, an upper 104 may include a first region 180 having a first set of properties and a second region 182 having a second set of properties is illustrated. The first region 180 may be positioned to extend from the lateral edge toward medial edge of the top of the wearer's foot (not shown). In FIG. 10, the first region 180 may be positioned to extend from the lateral and proximal area of the top of the wearer's foot over the metatarsal bones and toward the hallux of the wearer's foot.

The first region 180 of the upper 104 may define a plurality of openings that are configured to expand and contract in elastic movement and in response to the movement of the wearer's foot 102. The second region 182 may be positioned to surround or substantially surround the first region 180 and may extend from the lateral and proximal area of the top of the wearer's foot over the metatarsal bones and toward the phalanx hallux of the wearer's foot, in similar fashion to the first region 180.

The first region 180 of the upper 104 may have a first elasticity and the second region 182 may have a second elasticity that is less than the first elasticity. The first region 180 may also have a first breathability and the second region 182 may have a second breathability that is less than the second elasticity. Thus, the first region 180 may cause the upper 104 to flex and compress greater than the second region 182. Additionally, the first region 180 may cause a greater amount of air to transcend the upper 104 and contact the top portion of the wearer's foot. Further, the first region 180 may cause sweat created from the wearer's foot to shed quickly and easily.

The first region 180 and the second region 182 of the upper 104 may be formed from the same material or may be formed from different materials that are attached to one another. In FIG. 9, the first region 180 and the second region 182 are formed from the same material.

In yet another embodiment, a gymnastics shoe may include an outsole 104 that contains the plural traction elements 146 and a divider 168. The divider 168 may define a medial region 170 and a lateral region 172 of the outsole, as described in detail above. The divider 168 may extend from a distal surface of the outsole 104 into the forefoot region 112 of the outsole. The medial region 170 and the lateral region 172 of the outsole may have a plurality of traction elements 146 that may be shaped like a polygon.

Figure 12:
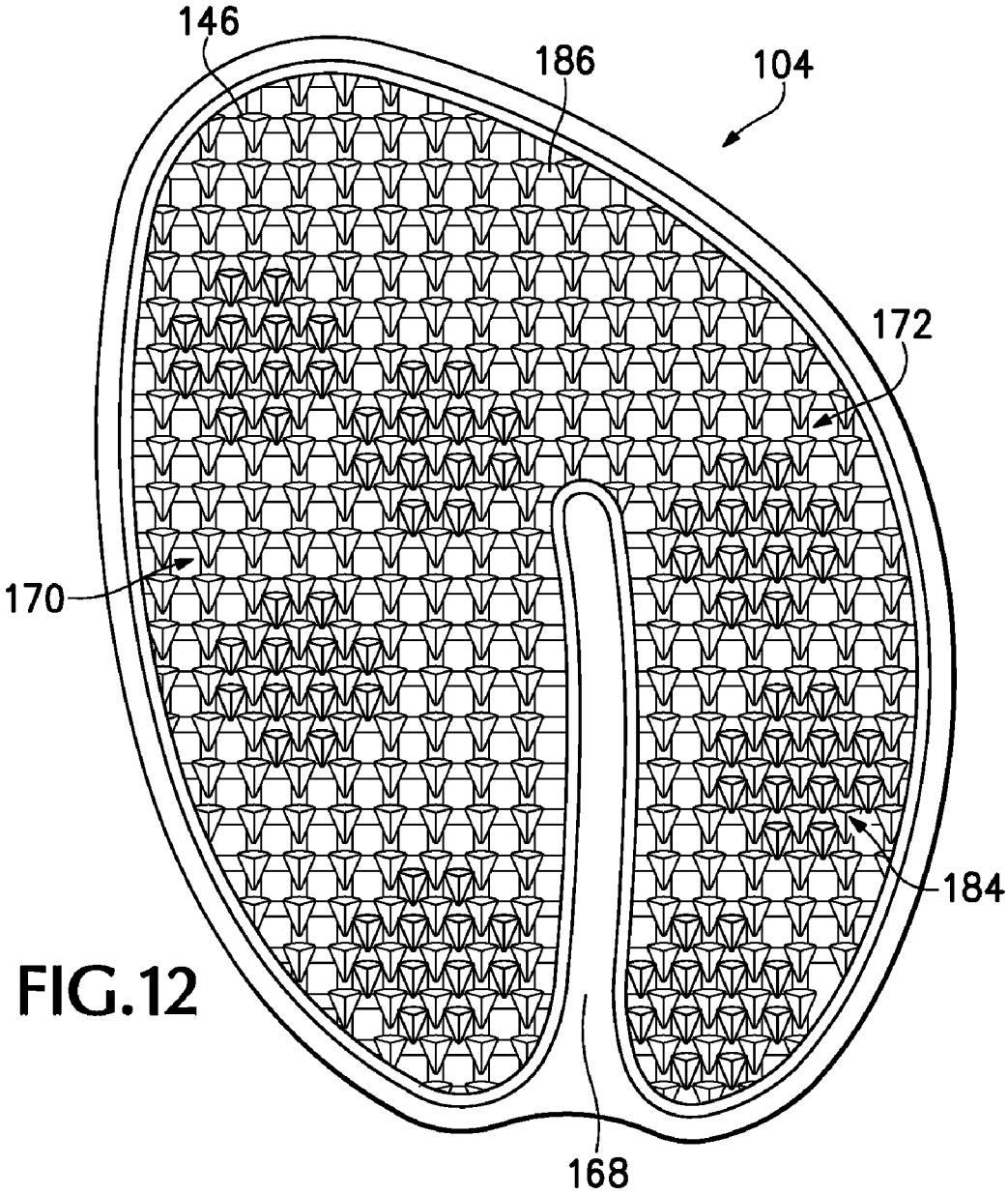
FIG. 12 illustrates another example of an outsole including features according to at least some aspects of the invention.

The polygon may be a pyramid shape that is configured to include three sides that define a point, described in detail above. The sides may be flat or curved. Each of the three sides may be the same dimensions, two of the sides may be of the same dimensions, or each side may be of a different dimension, as described in conjunction with FIG. 9 above. As shown in FIG. 12, one of the flat sides of the pyramid may be arranged to generally face the rear of the foot so as to provide a larger traction providing surface in the direction of the application force, e.g., when a wearer runs down the vault runway.

The illustrated arrangement of traction elements 146 shown in FIG. 12 may include clustered areas to provide improved traction at various locations where the foot typically contacts and exerts force against the ground or landing surface during a wearer's use. The clusters of traction elements 184 may be circular-shaped or any other desired arrangement.

Each of the traction elements may be interconnected by a frame 186. The frame 186 may be configured as horizontal and vertical strips that are evenly spaced apart. The frame 186 may be attached to the outsole of the gymnastics shoe. The traction elements 146 may be attached to the frame 186 along the sides of the squares of the frame 186. For example, in FIG. 12, the traction elements 146 are attached to the frame 186 in two different patterns. A first portion of the traction elements 146 are positioned along the straight edges of the square, as described above. A second portion of the traction elements may be positioned at or near the corners or right angles of the square. The cluster of traction elements 184 may include traction elements that are positioned along the straight edge of the square and at the corners of the square. The cluster of traction elements 184 may also include traction elements that are positioned within the center portion of the square. In effect, in the clusters of traction elements 184, additional traction elements 146 are positioned in the interstitial areas between the regularly spaced traction elements provided along the frame 186.

While the figures generally illustrate the various traction elements oriented in the same manner over the entire outsole structure, this is not a requirement. Rather, if necessary or desired, a variety of orientations may be present, such as orientations in one direction in one region of the outsole and orientations in a different direction in another region of the same outsole. Also, different orientations and/or arrangements of traction elements may be provided for different shoes, e.g., depending on the intended use, desired design or aesthetics, etc.

The article of footwear 100 may be made in a neutral beige, tan, or brown shade of color, e.g., in order to avoid attracting undue attention to the wearer's foot 102. Of course, the article of footwear 100 may be any desirable color or may exhibit any desirable image or logo on any surface thereof, without departing from the invention.

C. Conclusion

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

The invention claimed is:

1. A gymnastics shoe, comprising:

an outsole sized to extend beneath a forefoot region of a wearer's foot, wherein the outsole terminates in a midfoot region of the wearer's foot, and wherein an exposed surface of the outsole includes one or more traction elements;

an insole engaged with the outsole and providing a surface for engaging a wearer's foot, wherein the insole includes a medial forefoot impact-attenuation zone, a lateral forefoot impact-attenuation zone, and a central zone adjacent the medial and lateral forefoot impact-attenuation zones, the medial and lateral forefoot impact-attenuation zones being formed of different materials and having impact-attenuation properties different than each other and than impact-attenuation properties of the central zone;

an upper including plural apertures for receiving phalanges of a wearer's foot, the upper extending over a top portion of the wearer's foot between the wearer's ankle and phalanges; and a securing member extending from a lateral side of the upper to a medial side of the upper, the securing member forming a loop to extend around a rear heel or ankle area of the wearer's foot.

2. The gymnastics shoe of claim 1, wherein the traction elements are configured to frictionally engage with a ground surface.

3. The gymnastics shoe of claim 1, wherein each of the traction elements are shaped to be a web.

4. The gymnastics shoe of claim 1, wherein each of the traction elements are shaped to be a polygon.

5. The gymnastics shoe of claim 4, wherein the polygon is shaped to be a pyramid having a first side, a second side, and a third side, wherein at least one of the first side, the second side, and the third side is substantially flat.

6. The gymnastics shoe of claim 1, wherein a first set of the traction elements are shaped to be a first shape and a second set of the traction elements are shaped to be a second shape that is different from the first shape.

7. The gymnastics shoe of claim 1, wherein the exposed surface includes a first area having a first density of traction elements and a second area having a second density of traction elements that is different from the first density.

8. The gymnastics shoe of claim 1, wherein the insole includes a plurality of friction elements positioned on an interior surface, the friction elements configured to create friction between the interior surface and the wearer's foot.

9. The gymnastics shoe of claim 1, wherein the upper includes a first region having a first set of properties and a second region having a second set of properties that is different from the first set of properties.

10. The gymnastics shoe of claim 9, wherein the first set of properties includes a first elasticity and the second set of properties includes a second elasticity that is different from the first elasticity.

11. The gymnastics shoe of claim 9, wherein the first set of properties includes a first breathability and the second set of properties includes a second breathability.

12. An article of footwear, comprising:

an outsole sized to extend beneath a forefoot region of a wearer's foot, wherein the outsole terminates in a mid-foot region of the wearer's foot, and wherein an exposed surface of the outsole includes one or more traction elements;

an insole engaged with the outsole and providing a surface for engaging a wearer's foot, wherein the insole includes plural discrete impact-attenuation zones, a first of the impact-attenuation zones having impact-attenuation properties different than impact-attenuation properties of a second impact-attenuation zone and being formed of a material that is different than a material of which the second impact-attenuation zone is formed;

an upper including at least one aperture through which at least one phalange of a wearer's foot extends, the upper extending over a top portion of the wearer's foot between the wearer's ankle and phalanges; and a securing member for securing the shoe to the wearer's foot.

13. The article of footwear of claim 12, wherein the fraction elements are configured to frictionally engage with a ground surface.

14. The article of footwear of claim 12, wherein each of the traction elements are shaped to be a web.

15. The gymnastics shoe of claim 12, wherein each of the traction elements are shaped to be a polygon.

16. The gymnastics shoe of claim 15, wherein the polygon is shaped to be a pyramid having a first side, a second side, and a third side, wherein at least one of the first side, the second side, and the third side is substantially flat.

17. The article of footwear of claim 12, wherein a first set of the traction elements are shaped to be a first shape and a second set of the traction elements are shaped to be a second shape that is different from the first shape.

18. The article of footwear of claim 17, wherein the first shape is a polygon and the second shape is a circle.

19. The article of footwear of claim 12, wherein the insole includes a plurality of friction elements positioned on an interior surface, wherein the friction elements are configured to create friction between the interior surface and the wearer's foot.

20. The article of footwear of claim 12, wherein the upper includes a first region having a first set of properties and a second region having a second set of properties that is different from the first set of properties.

21. The article of footwear of claim 20, wherein the first set of properties includes a first elasticity and the second set of properties includes a second elasticity that is different from the first elasticity.

22. The article of footwear of claim 20, wherein the first set of properties includes a first breathability and the second set of properties includes a second breathability.

23. The article of footwear of claim 12, wherein at least one of the apertures is positioned to extend over at least one metatarsal of a hallux.

24. The article of footwear of claim 12, wherein the securing member includes a heel strap that extends from a lateral side of the upper to a medial side of the upper, and wherein the heel strap is engaged with the rear heel or ankle area of the wearer's foot.

25. A gymnastics shoe, comprising:

an outsole sized to extend beneath a forefoot region of a wearer's foot, wherein the outsole includes a ground contact surface having one or more traction elements;

an insole engaged with the outsole including plural discrete impact-attenuation zones, a first of the impact-attenuation zones having impact-attenuation properties different than impact-attenuation properties of a second impact-attenuation zone and being formed of a material that is different than a material of which the second impact-attenuation zone is formed;

an upper including plural apertures for receiving phalanges of a wearer's foot;

a securing member for securing the gymnastics shoe to the wearer's foot, the securing member including a heel strap that extends from a lateral side of the upper to the medial side of the upper;

wherein the upper and the insole define a space for fittingly engaging with the wearer's foot.

* * * * *